US008607490B1

(12) United States Patent
Zinsner

(10) Patent No.: US 8,607,490 B1
(45) Date of Patent: Dec. 17, 2013

(54) QUICK RELEASE HAND GUARD ASSEMBLY FOR A RIFLE

(76) Inventor: Brendon B Zinsner, Sarasota, FL (US)

( * ) Notice: Subject to any disclaimer, the term of this patent is extended or adjusted under 35 U.S.C. 154(b) by 287 days.

(21) Appl. No.: 13/106,357

(22) Filed: May 12, 2011

(51) Int. Cl.
*F41C 23/16* (2006.01)

(52) U.S. Cl.
USPC ..... 42/71.01; 42/75.03; 42/85

(58) Field of Classification Search
USPC ..... 42/71.01, 72, 73, 85, 90, 124, 75.03
See application file for complete search history.

(56) References Cited

U.S. PATENT DOCUMENTS

| | | | | |
|---|---|---|---|---|
| 6,959,509 | B2 * | 11/2005 | Vais | 42/75.02 |
| RE39,465 | E * | 1/2007 | Swan | 42/71.01 |
| RE40,216 | E * | 4/2008 | Swan | 42/71.01 |
| 8,037,633 | B1 * | 10/2011 | Troy | 42/71.01 |
| 8,091,265 | B1 * | 1/2012 | Teetzel et al. | 42/72 |
| 8,276,303 | B2 * | 10/2012 | Kapusta et al. | 42/71.01 |
| 8,347,540 | B2 * | 1/2013 | Sirois | 42/75.01 |
| 2005/0241211 | A1 * | 11/2005 | Swan | 42/124 |
| 2006/0010748 | A1 * | 1/2006 | Stoner et al. | 42/71.01 |
| 2011/0061281 | A1 * | 3/2011 | Kapusta et al. | 42/71.01 |
| 2011/0126443 | A1 * | 6/2011 | Sirois | 42/90 |
| 2011/0192066 | A1 * | 8/2011 | Kimmel et al. | 42/71.01 |
| 2011/0239513 | A1 * | 10/2011 | Sandman | 42/90 |
| 2012/0036756 | A1 * | 2/2012 | Brown | 42/71.01 |
| 2012/0042557 | A1 * | 2/2012 | Gomez et al. | 42/90 |
| 2012/0124880 | A1 * | 5/2012 | Leclair | 42/71.01 |
| 2012/0180358 | A1 * | 7/2012 | Samson et al. | 42/71.01 |
| 2013/0055613 | A1 * | 3/2013 | Gomez et al. | 42/90 |
| 2013/0097910 | A1 * | 4/2013 | Daniel et al. | 42/72 |

* cited by examiner

*Primary Examiner* — Benjamin P Lee
(74) *Attorney, Agent, or Firm* — Dorothy S. Morse

(57) ABSTRACT

A quick release, free floating, multi-piece forward hand guard assembly for a rifle includes an inner barrel nut adapted to be affixed to a front of the rifle receiver and an outer barrel nut telescopically received over the inner barrel nut and longitudinally secured thereto. The outer barrel nut is non-rotatable with respect to the inner barrel nut. A first hand guard element is engaged with and extends forwardly from the outer barrel nut in a laterally stable cantilevered fashion, and a second hand guard element is matingly engaged with the first hand guard element for surrounding the rifle's barrel and is free floating therefrom. The second hand guard element is attached to the first hand guard element with at least one quick release fastener.

26 Claims, 8 Drawing Sheets

QUICK RELEASE HAND GUARD ASSEMBLY FOR A RIFLE

FIELD OF THE INVENTION

The present disclosure generally relates to gunstocks for rifles. More particularly, the present disclosure relates to a two-piece cantilevered forward shield for an automatic rifle.

BACKGROUND OF THE INVENTION

Gunstocks for handheld weapons date back to the sixteenth century and are derived from the Germanic word 'stoc', meaning tree trunk, referring to the wooden nature of the gunstock. Those early 'hand cannons' used a simple stick fitted into a socket in the breech end of the weapon to provide a handle for the user. Over the following centuries, gunstocks typically remained fashioned from wood, although the shape of the gunstock evolved to the gunstock of the twentieth century that is most recognizable with a butt stock for placing against a shooter's shoulder including a grip and a fore end or hand guard. Initially, gunstocks were one piece from butt to fore end, but certain weapon configurations lent themselves to two-piece stocks where the fore end was separate from the butt and grip.

The evolution of the rifle, and especially with respect to the genre of weapons categorized as assault rifles or assault weapons, has resulted in the use of gunstock hand guards that are separate from the remaining stock members. Particularly, these modern weapons are generally militarized weapons and are utilized by and mass-produced for arming of a country's armed forces. While traditional gunstocks have been machined from wooden blanks, consideration for weapon quantities, durability in adverse environments, ease of fabrication, and versatility have relegated the wooden gunstock in military weapons to the annals of history. Today's gunstocks are typically formed of metal, injection molded thermoplastic, or a combination of the two.

In particular, the separate gunstock hand guard fulfills multiple functions. The primary purpose of the hand guard is to insulate the shooter's hand from the heat of the rifle barrel. Secondly, the hand guard can include provisions for mounting accessories to the weapon such as, for example, a flashlight aligned with the barrel to illuminate the area in front of the weapon in low light or dark lighting conditions. Initially, on early rifles, such provisions were almost exclusively used for mounting telescopic sights and were thus formed on the top portion of the rifle's receiver. However, for militarized assault rifles such as the M16, these provisions are found on the hand guard and are commonly known as Picatinny rails. One or more Picatinny rails can usually be found on each hand guard. Picatinny rails (developed at the Picatinny Arsenal) are standardized, the dimensional specifications being found in MIL-STD-1913 or STANAG 2324. Hand guards can be either permanently mounted to the weapon or can be of a "quick attach/detach" design.

With normal rifles, the barrel rests in contact with the stock and in particular with the fore end or hand guard portion of the stock. If the stock is manufactured of wood, environmental conditions or operational use may shift the alignment of the stock, which, in turn, may cause the barrel to shift its alignment slightly over time. This shift can alter the flight path of the projectile and thus its impact point. Contact between the barrel and the stock also interferes with the natural frequency of the barrel, which, in some cases, can be detrimental on the weapon's accuracy. The interference of the stock with the barrel's forced oscillation as the projectile passes down the bore can cause the barrel to vibrate inconsistently from shot to shot, depending on the external forces acting upon the stock at the time of the shot. Micro-vibrations acting during the projectile's passage result in differences in trajectory as the projectile exits the bore, thus changing the downrange impact point.

One method of minimizing this detrimental interference between the hand guard and the barrel has been to free float the barrel with respect to the hand guard. Specifically, the barrel and the hand guard are each independently affixed to the weapon's receiver and project forward from the receiver in cantilevered fashion. The barrel and stock are designed to not touch at any point along the barrel's length. The barrel is "free floating" and does not contact other gun parts, other than the weapon's front sight. The free floating of the barrel minimizes possible mechanical pressure distortions of the barrel alignment, and allows vibration to occur at the barrel's natural frequency. The trend has been to outfit these weapons with free-floating barrels and hand guards. However, to maintain stability of the free floating hand guard, the attachment of the hand guard has typically been of a permanent attachment, or alternatively of a one-piece quick attach design to prevent the lateral shifting of hand guard elements with respect to each other in multiple-piece hand guards.

Single piece hand guards, even if quickly detachable, typically also require the highly undesirable removal of the front sight from the barrel in order to facilitate total removal. Conversely, quickly detachable hand guards of a multiple piece (usually two pieces) design are not free floating and are typically attached to the front end of the barrel. Therefore, a free floating, quick attach hand guard that is also stable and of a two-piece design is needed.

SUMMARY OF THE INVENTION

The present disclosure is generally directed to a quick release, free floating, multi-piece forward hand guard assembly for a rifle. The hand guard assembly includes an inner barrel nut adapted to be affixed to a front of the rifle receiver and an outer barrel nut telescopically received over the inner barrel nut and longitudinally secured thereto. The outer barrel nut is non-rotatable with respect to the inner barrel nut. A first hand guard element is engaged with and extends forwardly from the outer barrel nut in a laterally stable cantilevered fashion, and a second hand guard element is matingly engaged with the first hand guard element for surrounding the rifle's barrel and is free floating therefrom. The second hand guard element is attached to the first hand guard element with at least one quick release fastener.

In another aspect, a rifle of the type having a receiver and a barrel extending from a front portion of the receiver includes a quick release, free floating, multi-piece forward hand guard assembly affixed to the receiver. The hand guard assembly comprises an inner barrel nut removably affixed to the front portion of the receiver and an outer barrel nut is telescopically received over the inner barrel nut and longitudinally secured thereto. The outer barrel nut includes rearwardly extending tabs laterally spaced one from the other and closely receiving the front portion of the receiver therebetween. First and second hand guard elements are attached one to the other with at least one quick release fastener wherein the elements in combination encircle the barrel and have one end secured to the outer barrel nut and have a second end free floating with respect to the barrel in a laterally stable cantilevered fashion.

These and other features, aspects, and advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
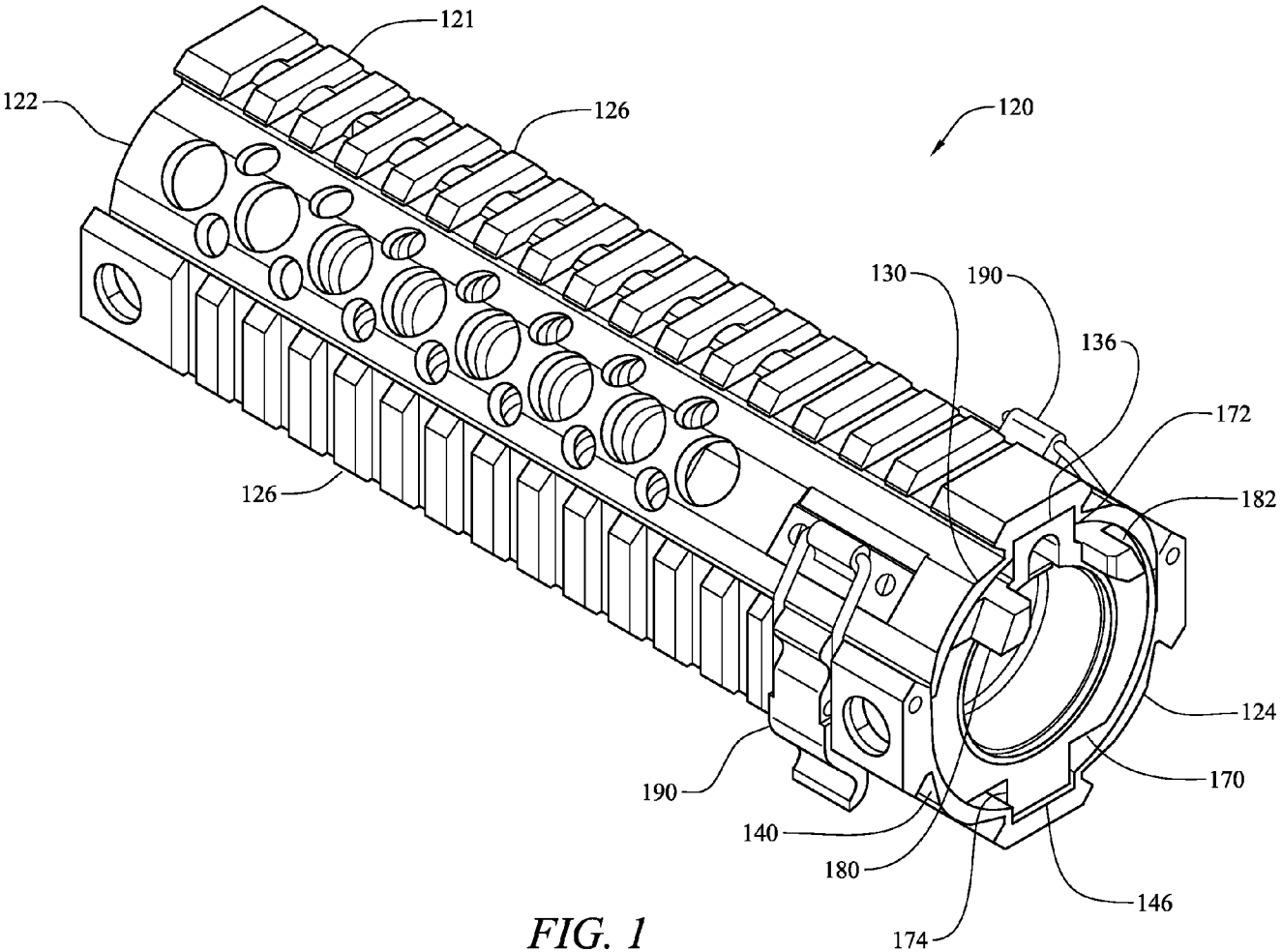
FIG. 1 presents a rear perspective view of a rifle hand guard assembly embodying the present invention wherein the front of the hand guard is free floating and the hand guard is quickly detachable from the rifle.
Figure 8:
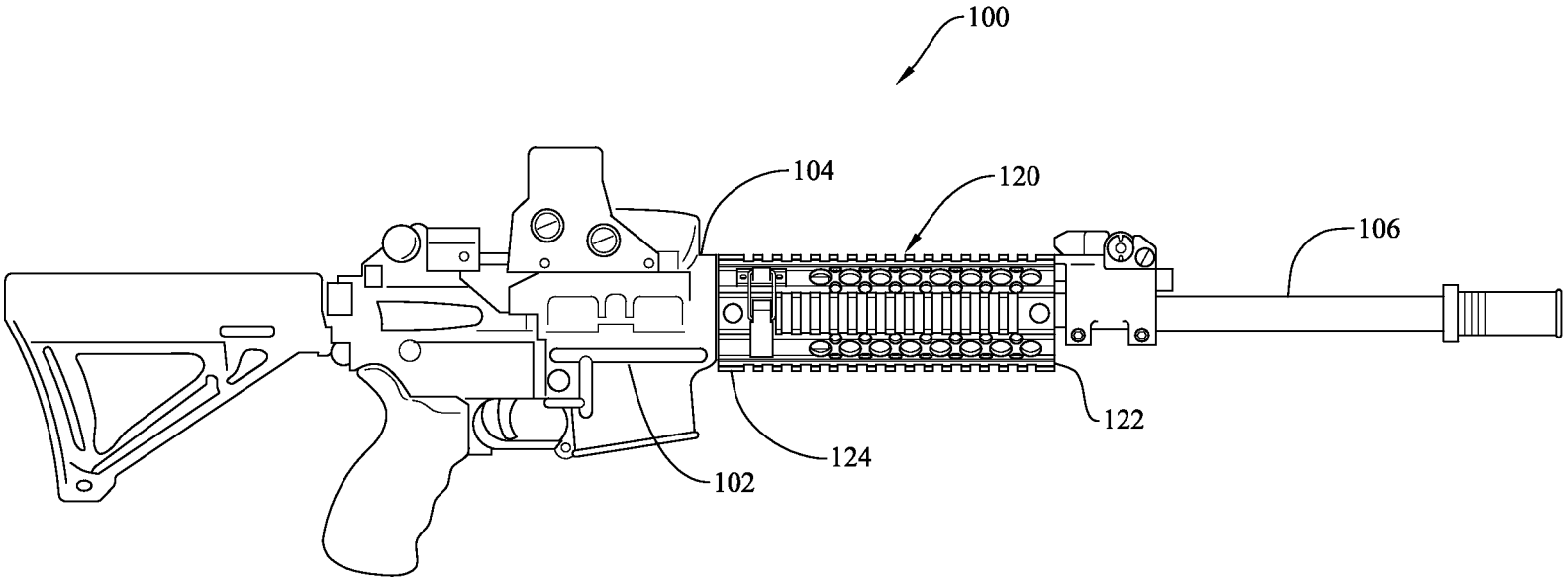
FIG. 8 presents a side elevation view of an assault weapon with the hand guard of FIG. 1 attached thereto.
Figure 9:
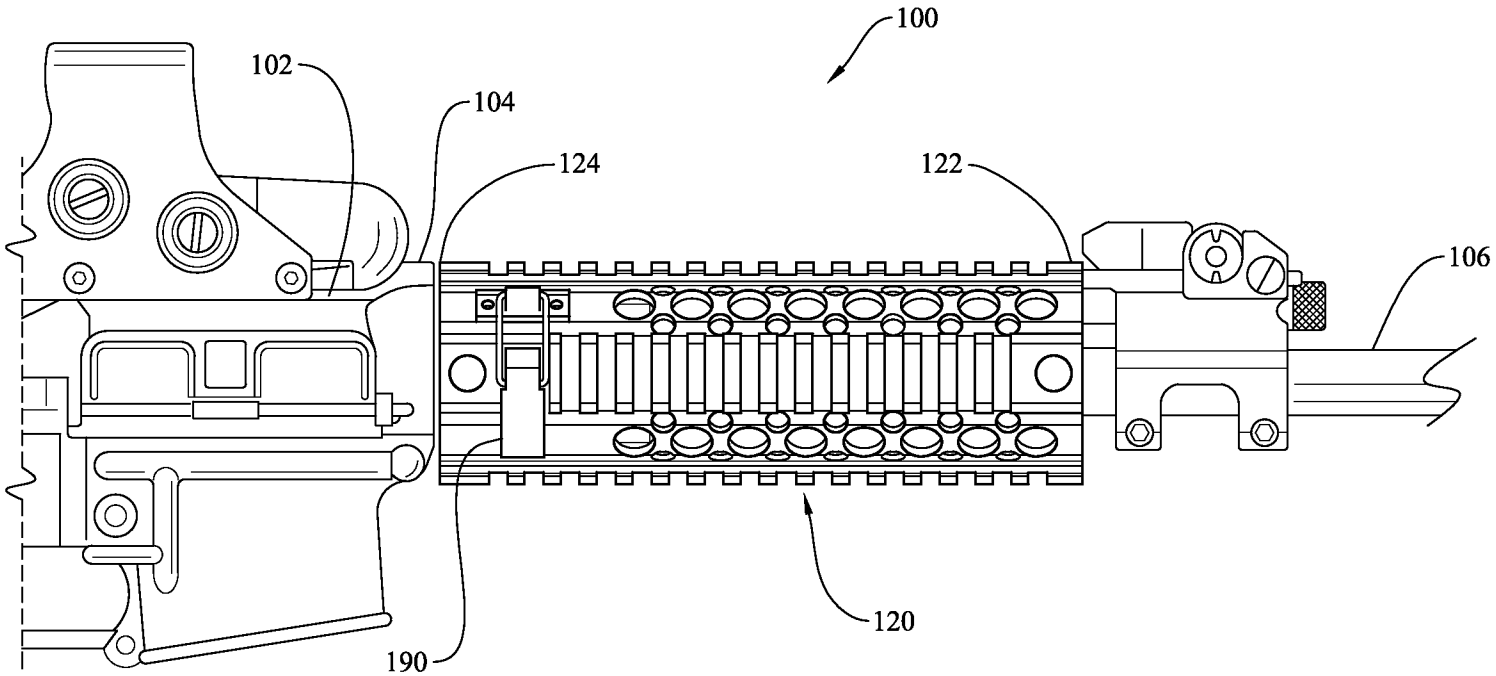
FIG. 9 is an enlarged view of the attached hand guard of FIG. 8.

Turning to the drawings, FIG. 1 shows a hand guard assembly 120 (the inner barrel nut 150 has been removed for clarity), which is one of the preferred embodiments of the present invention and illustrates its various components. Referring to FIGS. 1-7, hand guard assembly 120 includes, as most clearly seen in FIGS. 3-4, an inner barrel nut 150. Inner barrel nut 150 has a generally tubular configuration defining a central passage 151 with an internal female thread 152 at a rear end 160 to mate with and receive the male threads of the forward end 104 of a receiver 102 of rifle 100 (FIG. 8). The tubular configuration of barrel nut 150 includes a central axis 128, which corresponds to the central axis of hand guard assembly 120 and to the central axis of the bore of rifle barrel 106. Those practiced in the art will readily understand that the external male threads on receiver 104 may be different on different rifle designs and therefore that internal threads 152 may be adapted to the particular design of rifle 100 so that inner barrel nut 150 may be securely affixed to receiver 104 (FIG. 8). Central passage 151 permits inner barrel nut 150 to be sleeved over barrel 106 of rifle 100. Barrel nut 150 may7 also include a slot 154 for receiving an end of a spanner wrench (not shown) for tightening inner barrel nut 150 onto receiver 104 in a manner common to and known to those practiced in the art. Inner barrel nut 150 further defines at least one and most preferably two grooves 156, 158 axially or longitudinally spaced one from the other and extending about an external periphery of barrel nut 150.

Figure 5:
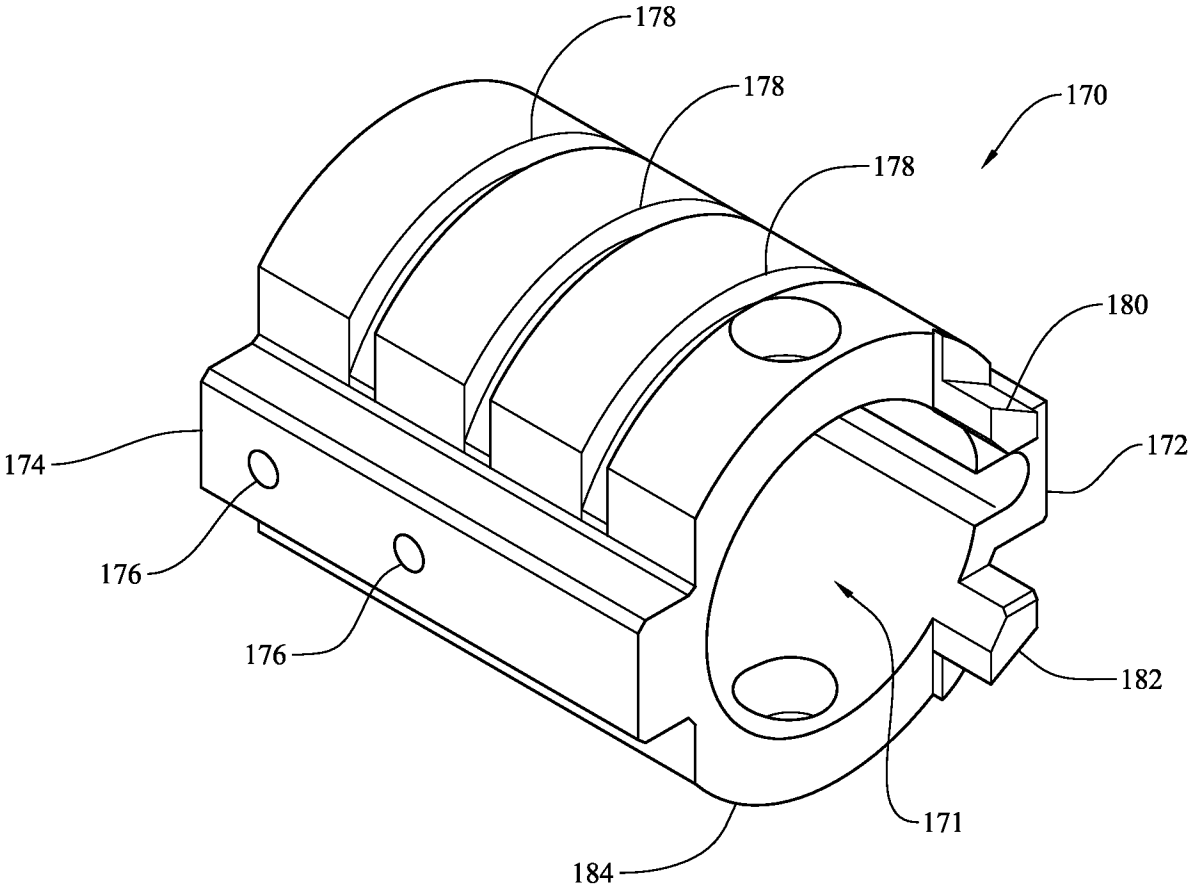
FIG. 5 presents a rear perspective view of the outer barrel nut and rotated ninety degrees clockwise.
Figure 6:
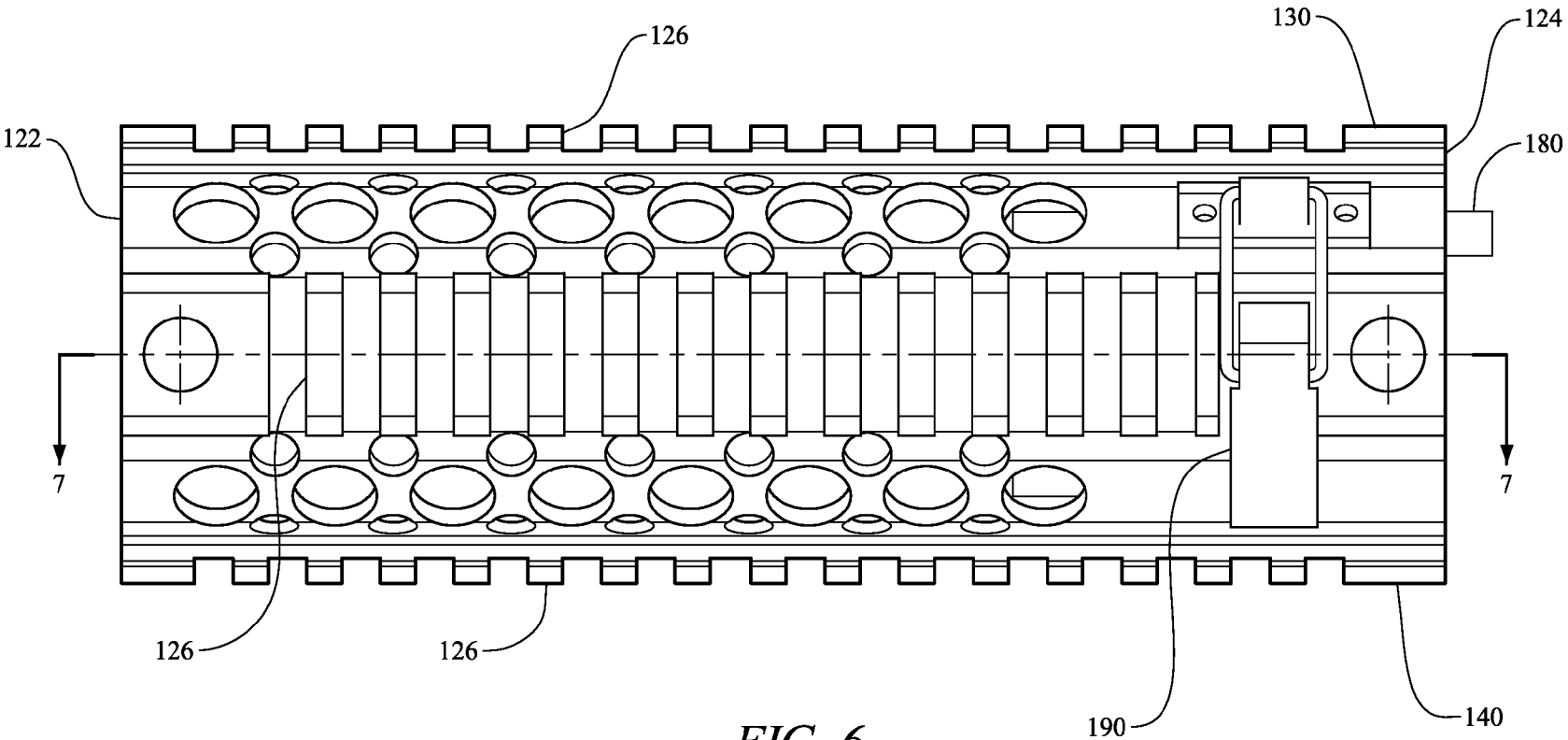
FIG. 6 presents a side elevation view of the assembled hand guard.
Figure 7:
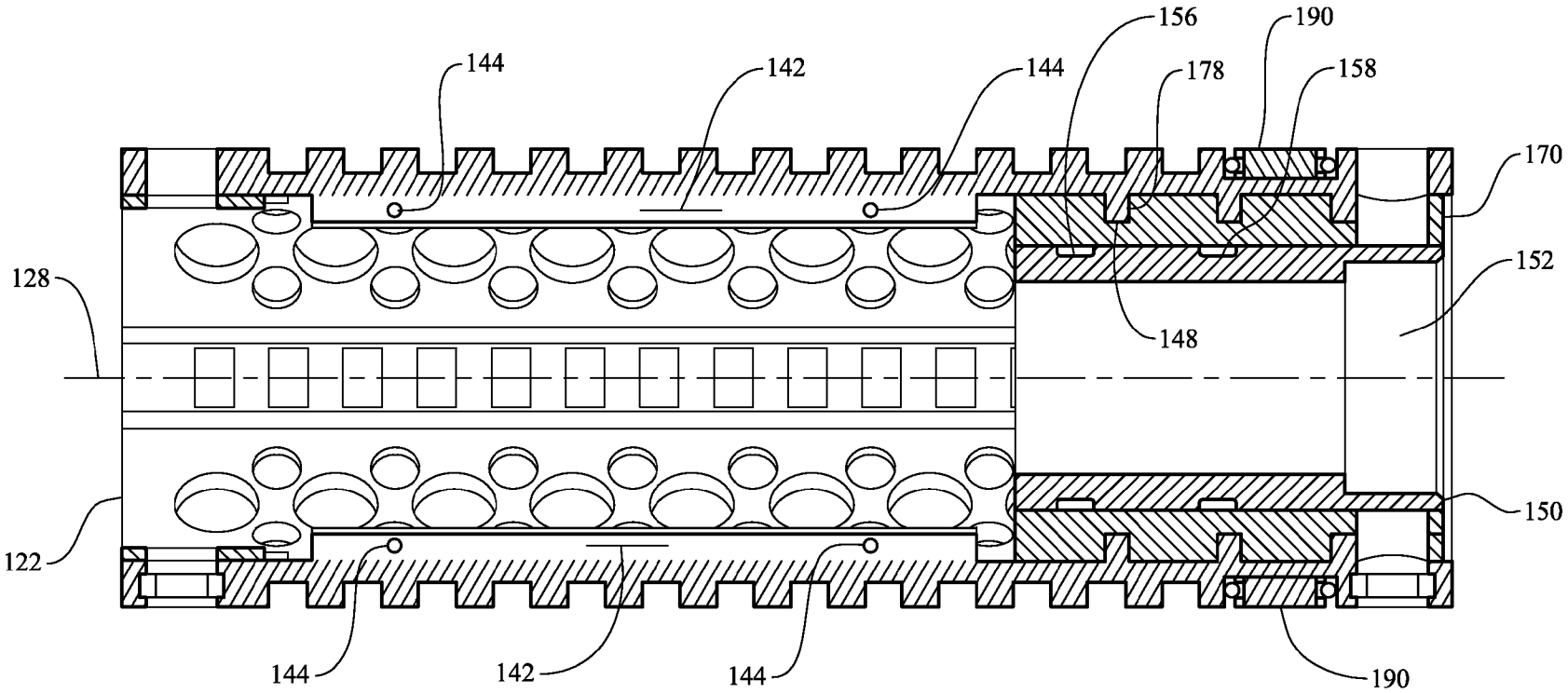
FIG. 7 presents a cross-sectional view of the hand guard shown in FIG. 6 and taken along the line 7-7, FIG. 6.

Referring now to FIG. 5, outer barrel nut 170 is shown in rear perspective and rotated ninety degrees clockwise to most clearly illustrate its features. Outer barrel nut 170 defines a central passageway 171 having a diameter to closely receive inner barrel nut 150 therein in a telescopic manner. A rear end 184 of outer barrel nut 170 includes two rearwardly projecting tabs 180, 182 which are laterally spaced one from the other. The spacing of tabs 180, 182 is such to closely receive therebetween a forward portion of receiver 104 of rifle 100. Outer barrel nut 170 also includes a top axial rib 172 and a bottom axial rib 174. Bottom axial rib 174 further defines two holes 176 extending therethrough, each hole 176 threaded to receive a set screw (not shown) therein. A plurality of grooves 178 extend about at least a portion of the external periphery of outer barrel nut 170, grooves 178 being substantially identical one with the other and equally spaced along the length of outer barrel nut 170. Outer barrel nut 170 further acts as a heat sink for the heat energy generated by the hot gasses and friction of the projectiles traveling through the bore of barrel 106 to insulate the high temperature generated from firing rifle 100 to the user's hands grasping hand guard assembly 120.

Figure 2:
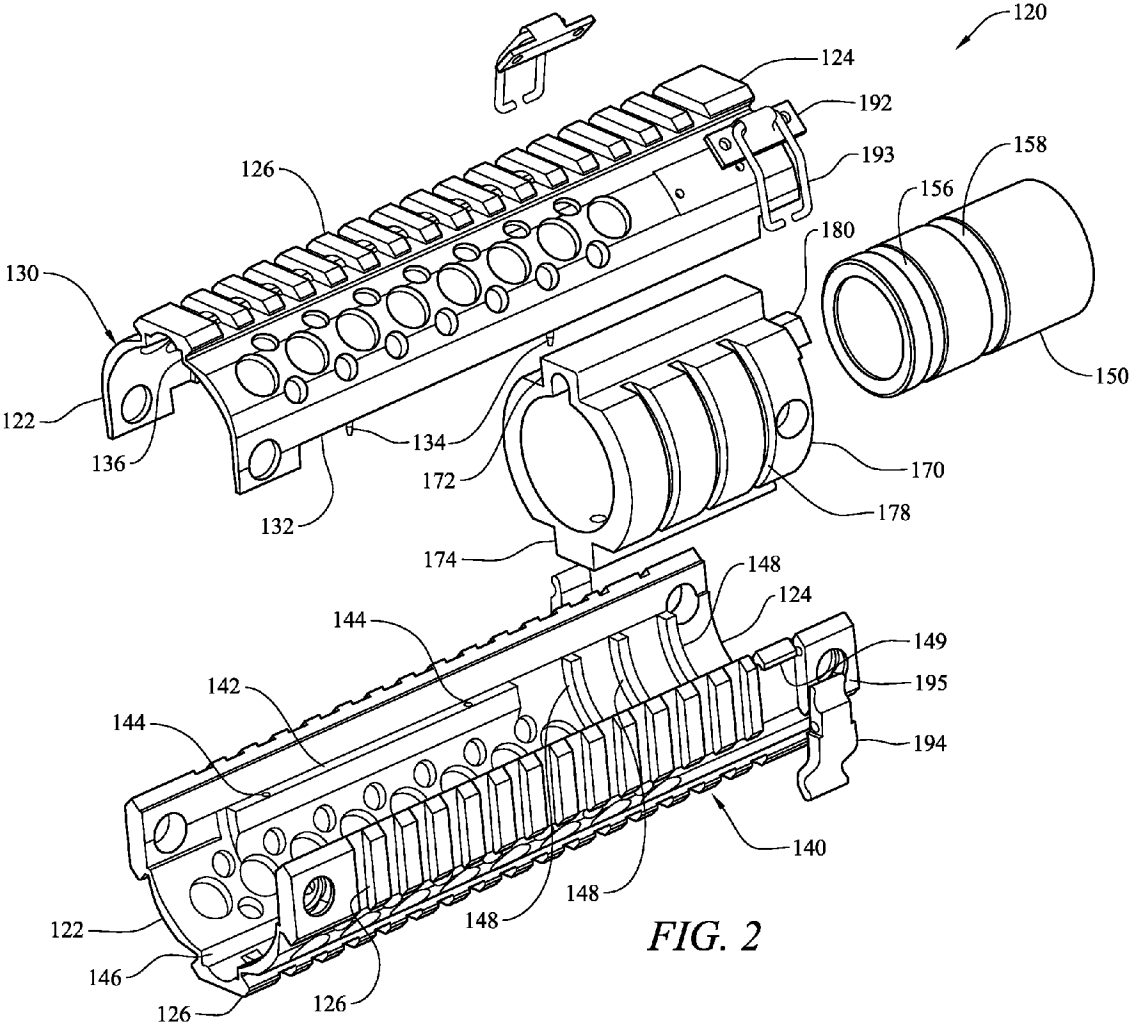
FIG. 2 presents an exploded front perspective view of the free floating hand guard.
Figure 4:
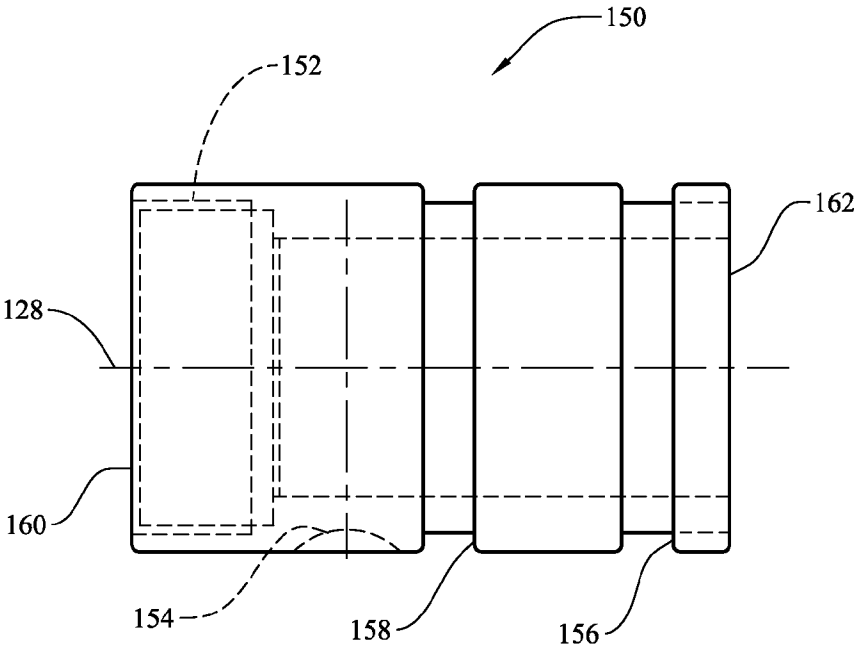
FIG. 4 presents an elevation view of the inner barrel nut.
Figure 3:
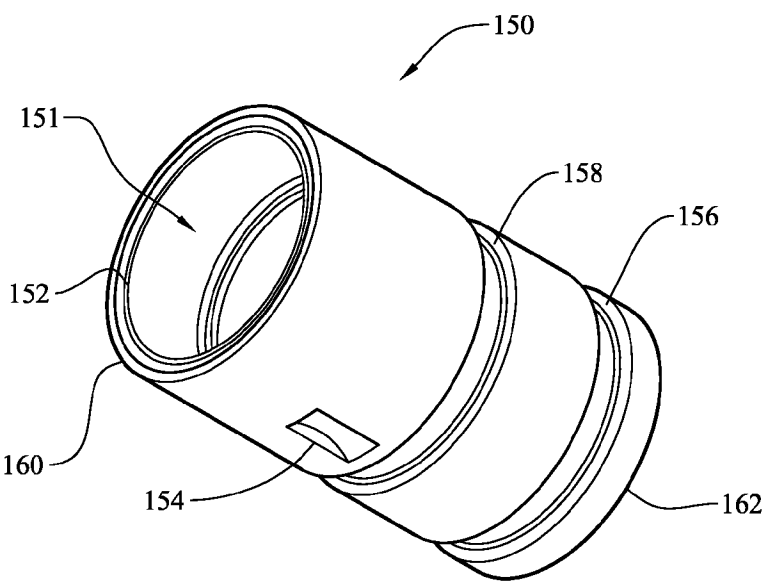
FIG. 3 presents a bottom rear perspective view of the inner barrel nut.

Hand guard 121 is a combination of hand guard elements 130, 140, which are most clearly illustrated in FIG. 2 wherein top hand guard element 130 has a generally semi-tubular configuration. Top hand guard element 130 includes an axially aligned accessory rail 126 extending along a top surface of hand guard element 130. Accessory rail 126 may be of any configuration that accepts accessories adapted for mounting on a rifle such as telescopic sights, flashlights, etc. As such, and as shown, accessory rails 126 shown on hand guard 121 conform to MIL-STD-1913 or STANAG 2324, the details of which are well known in the art and are not described further herein. The semi-tubular configuration of top guard element 130 has a mating edge 132 along each side of element 130 and at least one and preferably a plurality of regularly spaced alignment pins 134 extending downwardly from edge 132. Top hand guard element 130 defines, at an inner top portion, an axially or longitudinally aligned channel 136 sized to closely receive top axial rib 172 of outer barrel nut 170.

Bottom hand guard element 140 also has a generally semi-tubular configuration and can include, as shown, multiple accessory rails 126 spaced about the periphery thereof. Bottom hand guard element 140 also includes a mating edge 142 along each side thereof. Mating edge 142 defines a plurality of alignment holes 144 therealong and regularly spaced to receive alignment pins 134 of top hand guard 130 and to securely seat top mating edges 132 against bottom mating edges 142 when top hand guard element 130 and bottom hand guard element 140 are combined to form hand guard 121. As most clearly illustrated in FIG. 2, bottom hand guard element 140 includes a plurality of axially spaced inner circumferential ribs 148. Ribs 148 are spaced to engage grooves 178 in outer barrel nut 170. Although not specifically illustrated, top hand guard element 130 includes a like number and like configured ribs as ribs 148 interior to top hand guard 130.

Elements 130, 140 are secured one to the other with at least one and preferably two quick release fasteners 190 positioned at a rear 124 of hand guard 121. While quick release faster 190 may be of any design facilitating the quick disassembly and subsequent assembly of hand guard elements 130, 140 one to the other, as shown, a quick release fastener 190 is positioned on each lateral side of hand guard 121 and is of an over-centering latch design known in the art and particularly adapted to be substantially conformal with the external shape of hand guard 121. In particular, over-centering latch 190 includes a movable wire form 193 and rotatably retained in a latch base 192 affixed to top hand guard element 130. A latch lever 194 is rotatably retained at an outer end of wire form 193 such that a lever end 195 can engage a hook 149 integrally formed at a rear portion 124 of bottom hand guard 140. The size and positioning of the elements of over-centering latch 190 are such that when latch lever 194 is fully engaged in hook 149 and closed, top hand guard element 130 is securely held in combination with bottom hand guard element 140 to form hand guard 121.

In use, and referring to FIGS. 1 and 6-9, hand guard assembly 120 is affixed to rifle 100 in the following manner. The rear portion 160 of inner barrel nut 150 is threaded onto the male threads of the front portion 104 of receiver 102 of rifle 100 (or affixed by the particular attachment provisions of a different design receiver). A spanner wrench (not shown) engages slot 154 whereby inner barrel nut 150 is securely torqued onto receiver 102.

Outer barrel nut (heat sink) 170 is telescoped over inner barrel nut 150 such that top axial rib 172 and tabs 180, 182 are oriented up. Outer barrel nut 170 is translated axially back such that the upper forward portion 104 of receiver 102 is captured between tabs 180, 182 and axially positioned such that holes 176 are in registration with grooves 156, 158 of inner barrel nut 150. Set screws (not shown) are then threaded into holes 176 and torqued to securely seat in grooves 156, 158 respectively. In this manner, tabs 180, 182 closely receiving front portion 104 of receiver 102 prevents outer barrel nut from rotating about inner barrel nut 170, and set screws firmly torqued in holes 176 to engage grooves 156, 158 of inner barrel nut 150 maintain outer barrel nut 170 in a fixed longitudinal position with respect to inner barrel nut 150.

The rear portion of bottom hand guard element 140 is engaged with the bottom portion of outer barrel nut 170 by closely engaging bottom axial rib 174 of outer barrel nut 170 in channel 146 of bottom hand guard element 140. Axial rib 174, engaged in channel 146, prevents lateral movement of bottom hand guard element 140 with respect to outer barrel nut 170. Further, bottom hand guard element 140 is axially adjusted such that inner circumferential ribs 148 are engaged in grooves 178 of outer barrel nut 170. The engagement of inner circumferential ribs 148 in grooves 178 prevents axial or longitudinal movement of bottom hand guard element 140 with respect to outer barrel nut 170. Once bottom hand guard element 140 is engaged with the bottom of outer barrel nut 170, top hand guard element 130 is similarly engaged with outer barrel nut 170. Specifically, top axial rib 172 of outer barrel nut is received in channel 136 of top hand guard element 130, and the inner circumferential ribs (not shown) are engaged in grooves 178 of outer barrel nut 170. Further, alignment pins 134 of top hand guard element 130 are received in alignment holes 144 of bottom hand guard element 140 to laterally secure top hand guard element 130 with respect to bottom hand guard element 140.

Once top and bottom hand guard elements 130, 140 are correctly positioned one to the other and on outer barrel nut 170, lever end 195 of each over-centering latch 190 is engaged in the respective hooks 149 of bottom hand guard element 140 and latch lever 194 is rotated to its over-center position securing top hand guard element 130 to bottom hand guard element 140 to form hand guard 121. In this manner hand guard 121 is also rigidly secured to outer barrel nut 170 such that the front end 122 of hand guard 121 is cantilevered over barrel 106 of rifle 100 and is free floating with respect to barrel 106 and all support for hand guard 121 is provided by inner and outer barrel nuts 150, 170. Top and bottom hand guard elements 130, 140 can be quickly removed by releasing over-centering latches 190 and disassembling hand guard 121 in reverse order as described above. Inner and outer barrel nuts 150, 170 can remain attached to receiver 102 and do not require removal to facilitate the removal of hand guard 121.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A quick release, free floating, multi-piece forward hand guard assembly for a rifle having a receiver and a barrel, said hand guard assembly comprising:

an inner barrel nut adapted to be affixed to a front of the receiver of the rifle, said inner barrel nut defining two circumferential grooves about a periphery thereof and axially spaced one from the other;

an outer barrel nut telescopically received over said inner barrel nut and longitudinally secured thereto, said outer barrel nut further including two set screws axially spaced in like manner to said two circumferential grooves, and each said set screw engaging one of said inner barrel nut circumferential grooves, causing said outer barrel nut to be non-rotatable with respect to said inner barrel nut;

a first hand guard element engaged with and extending forwardly from said outer barrel nut in a laterally stable cantilevered fashion; and a second hand guard element matingly engaged with said first hand guard element for surrounding the rifle's barrel, free floating therefrom, and attached to said first hand guard element with at least one quick release fastener.

2. The hand guard assembly according to claim 1 wherein said outer barrel nut further comprises at least one axially aligned rib protruding outwardly from an outer perimeter thereof and wherein at least one of said first and second hand guard elements defines an axially aligned channel for closely receiving said axial rib on said outer barrel nut for maintaining said hand guard element in axial alignment with the barrel of the rifle.

3. The hand guard assembly according to claim 2 wherein said outer barrel nut further comprises two axially aligned ribs protruding outwardly from an outer perimeter thereof, a first axial rib protruding from a top of said outer barrel nut and a second axial rib protruding from a bottom of said outer barrel nut and further wherein said first hand guard element defines an axially aligned channel for closely receiving said top axial rib and said second hand guard element defines an axially aligned channel for closely receiving said bottom axial rib.

4. The hand guard assembly according to claim 1 wherein said first and said second hand guard elements in combination define at least one accessory mounting rail.

5. The hand guard assembly according to claim 4 wherein said first and said second hand guard elements in combination define four axially oriented accessory mounting rails, said accessory mounting rails substantially equally spaced about a perimeter of said combined first and second hand guard elements.

6. The hand guard assembly according to claim 4 wherein said at least one accessory mounting rail conforms to MIL-STD-1913.

7. The hand guard assembly according to claim 1 wherein said inner barrel nut further comprises female threads at a rear end thereof for engaging mating male threads on the forward end of the rifle's receiver.

8. The hand guard assembly according to claim 1 wherein said outer barrel nut further comprises first and second tabs extending rearwardly therefrom, said tabs laterally spaced one from the other to closely receive therebetween a portion of the front of the receiver of the rifle.

9. The hand guard assembly according to claim 1 further comprising said first and said second hand guard elements adjoining at respective mating edges and further wherein said first hand guard element mating edge includes a plurality of alignment pins extending therefrom and said second hand guard element mating edge defines a plurality of alignment holes therein, said alignment pins received in said alignment holes to maintain said first and said second hand guard elements in a fixed lateral relationship one to the other.

10. The hand guard assembly according to claim 1 wherein said outer barrel nut further comprises at least one groove extending at least partially about a periphery thereof and further wherein said first and said second hand guard elements include at least one circumferential rib on an inner surface thereof, said circumferential rib engaging said at least one outer barrel nut groove, maintaining said first and said second hand guard elements in a fixed longitudinal relationship with said outer barrel nut.

11. The hand guard assembly according to claim 10 further comprising:

said outer barrel nut having at least one axially aligned rib protruding outwardly from an outer perimeter thereof and at least one of said first and second hand guard elements defines an axially aligned channel for closely receiving said axial rib on said outer barrel nut for maintaining said hand guard element in axial alignment with the barrel of the rifle;

said inner barrel nut including female threads at a rear end thereof for engaging mating male threads on the forward end of the rifle's receiver;

said outer barrel nut having first and second tabs extending rearwardly therefrom, said tabs laterally spaced one from the other to closely receive therebetween a portion of the front of the receiver of the rifle;

said first and said second hand guard elements further adjoining at respective mating edges and further wherein said first hand guard element mating edge includes a plurality of alignment pins extending therefrom and said second hand guard element mating edge defines a plurality of alignment holes therein, said alignment pins received in said alignment holes to maintain said first and said second hand guard elements in a fixed lateral relationship one to the other; and said first and said second hand guard elements in combination define at least one accessory mounting rail.

12. A quick release, free floating, multi-piece forward hand guard assembly for a rifle having a receiver and a barrel, said hand guard assembly comprising:

an inner barrel nut adapted to be affixed to a front of the receiver of the rifle;

an outer barrel nut telescopically received over said inner barrel nut and longitudinally secured thereto, said outer barrel nut further being non-rotatable with respect to said inner barrel nut, said outer barrel nut also including at least one groove extending at least partially about a periphery thereof;

a first hand guard element engaged with and extending forwardly from said outer barrel nut in a laterally stable cantilevered fashion;

a second hand guard element matingly engaged with said first hand guard element for surrounding the rifle's barrel, free floating therefrom, and attached to said first hand guard element with at least one quick release fastener; and further wherein said first and said second hand guard elements include at least one circumferential rib on an inner surface thereof, said circumferential rib engaging said at least one outer barrel nut groove maintaining said first and said second hand guard elements in a fixed longitudinal relationship with said outer barrel nut.

13. The hand guard assembly according to claim 12 wherein said outer barrel nut further comprises a plurality of axially spaced grooves extending at least partially about said periphery thereof and further wherein said first and said second hand guard elements include a like plurality of axially spaced inner circumferential ribs, each said rib engaging one of said grooves.

14. A quick release, free floating, multi-piece forward hand guard assembly for a rifle haying a receiver and a barrel, said hand guard assembly comprising:

an inner barrel nut adapted to be affixed to a front of the receiver of the rifle;

an outer barrel nut telescopically received over said inner barrel nut and longitudinally secured thereto, said outer barrel nut further being non-rotatable with respect to said inner barrel nut;

a first hand guard element engaged with and extending forwardly from said outer barrel nut in a laterally stable cantilevered fashion;

a second hand guard element matingly engaged with said first hand guard element for surrounding the rifle's barrel, free floating therefrom, and attached to said first hand guard element with at least one quick release fastener; and said first and said second hand guard elements adjoin at respective mating edges and further wherein said first hand guard element mating edge includes a plurality of alignment pins extending therefrom and said second hand guard element mating edge defines a plurality of alignment holes therein, said alignment pins received in said alignment holes to maintain said first and said second hand guard elements in a fixed lateral relationship one to the other.

15. The hand guard assembly according to claim 14 wherein said inner barrel nut further comprises female threads at a rear end thereof for engaging mating male threads on the forward end of the rifle's receiver.

16. The hand guard assembly according to claim 14 wherein said outer barrel nut further comprises first and second tabs extending rearwardly therefrom, said tabs laterally spaced one from the other to closely receive therebetween a portion of the front of the receiver of the rifle.

17. The hand guard assembly according to claim 14 wherein said outer barrel nut further comprises at least one groove extending at least partially about a periphery thereof, and further wherein said first and said second hand guard elements include at least one circumferential rib on an inner surface thereof, said circumferential rib engaging said at least one outer barrel nut groove, maintaining said first and said second hand guard elements in a fixed longitudinal relationship with said outer barrel nut.

18. The hand guard assembly according to claim 14 wherein said outer barrel nut further comprises at least one axially aligned rib protruding outwardly from an outer perimeter thereof and wherein at least one of said first and second hand guard elements defines an axially aligned channel for closely receiving said axial rib on said outer barrel nut for maintaining said hand guard element in axial alignment with the barrel of the rifle.

19. The hand guard assembly according to claim 14 further comprising said inner barrel nut defining two circumferential grooves about a periphery thereof and axially spaced one from the other, and said outer barrel nut further comprising two set screws axially spaced in like manner to said two circumferential grooves, and each said set screw engaging one of said inner barrel nut circumferential grooves, causing said outer barrel nut to be non-rotatable with respect to said inner barrel nut.

20. The hand guard assembly according to claim 14 wherein said first hand guard element and said second hand guard element in combination further define four axially oriented accessory mounting rails conforming to MIL-STD-1913, said accessory mounting rails substantially equally spaced about a perimeter of said combined first and second hand guard elements.

21. A rifle of the type having a receiver and a barrel extending from a front portion of said receiver, said rifle further including a quick release, free floating, multi-piece forward hand guard assembly affixed to said receiver, said hand guard assembly comprising:

first and second hand guard elements attached one to the other with at least one quick release fastener;

an inner barrel nut removably affixed to said front portion of said receiver;

an outer barrel nut telescopically received over said inner barrel nut and longitudinally secured thereto via rearwardly extending tabs laterally spaced one from the other and closely receiving said front portion of said receiver therebetween, said outer barrel nut also having a periphery and including a plurality of axially spaced grooves extending at least partially about said periphery, and wherein said first and said second hand guard elements include a like plurality of axially spaced inner circumferential ribs, each said circumferential rib engaging one of said outer barrel nut grooves to maintain said first and said second hand guard elements in a fixed longitudinal relationship with said outer barrel nut; and said first and second hand guard elements in combination encircling said barrel, said first and second hand guard elements also having one end secured to said outer barrel nut and having a second end free floating with respect to said barrel in a laterally stable cantilevered fashion.

22. The rifle according to claim 21 wherein said first and said second hand guard elements in combination further define at least one accessory mounting rail.

23. The rifle according to claim 22 wherein said first hand guard element and said second hand guard element in combination further define four axially oriented accessory mounting rails conforming to MIL-STD-1913, said accessory mounting rails substantially equally spaced about a perimeter of said combined first and second hand guard elements.

24. The rifle according to claim 21 wherein said inner barrel nut further defines at least one groove about a periphery thereof and further wherein said outer barrel nut includes a set screw for selective engagement with said at least one groove for securing said outer barrel nut to said inner barrel nut.

25. The rifle according to claim 21 wherein said outer barrel nut further comprises at least one axially aligned rib protruding outwardly from an outer perimeter thereof and wherein at least one of said first and second hand guard elements defines an axially aligned channel for closely receiving said at least one axially aligned rib on said outer barrel nut for maintaining said hand guard element in axial alignment with said barrel.

26. The rifle according to claim 21 further comprising said first and said second hand guard elements adjoining at respective mating edges, and wherein said first hand guard element mating edge includes a plurality of alignment pins extending therefrom and said second hand guard element mating edge defines a plurality of alignment holes therein, said alignment pins received in said alignment holes to maintain said first and said second hand guard elements in a fixed lateral relationship one to the other.

* * * * *